US011447911B2

(12) United States Patent
Shin et al.

(10) Patent No.: US 11,447,911 B2
(45) Date of Patent: Sep. 20, 2022

(54) GARMENT STEAMER

(71) Applicant: LG ELECTRONICS INC., Seoul (KR)

(72) Inventors: Woosup Shin, Seoul (KR); Woohee Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 36 days.

(21) Appl. No.: 17/230,148

(22) Filed: Apr. 14, 2021

(65) Prior Publication Data

US 2021/0230793 A1 Jul. 29, 2021

Related U.S. Application Data

(63) Continuation of application No. 16/474,704, filed as application No. PCT/KR2017/015706 on Dec. 29, 2017, now Pat. No. 11,008,698.

(30) Foreign Application Priority Data

Dec. 30, 2016 (KR) ..... 10-2016-0184193

(51) Int. Cl.
*D06F 73/00* (2006.01)
*D06F 71/18* (2006.01)

(52) U.S. Cl.
CPC ..... *D06F 73/00* (2013.01); *D06F 71/18* (2013.01)

(58) Field of Classification Search
CPC ..... D06F 73/00; D06F 71/18; D06F 71/20; D06F 71/28; D06F 71/285; D06C 3/08; D06C 15/00; D06C 5/00; A41H 5/00
See application file for complete search history.

(56) References Cited

U.S. PATENT DOCUMENTS 2,258,701 A 10/1941 Fitzgerald
2,454,977 A 11/1948 Richa
2,667,291 A 1/1954 Erwin
(Continued)

FOREIGN PATENT DOCUMENTS

CN 2127395 2/1993
CN 101063274 10/2007
(Continued)

OTHER PUBLICATIONS

Chinese Office Action dated Dec. 4, 2020.
(Continued)

*Primary Examiner* — Ismael Izaguirre
(74) *Attorney, Agent, or Firm* — Birch, Stewart, Kolasch & Birch, LLP

(57) ABSTRACT

A garment steamer includes a base body with a steam generator for generating steam, and a main body disposed at the upper side of the base body for moving the steam generated by the steam generator to the outside. A front press is hingedly fixed to the lower part of the main body to be attached to and detached from the front surface of the main body. A stretching means is disposed at opposite side surfaces of the main body to be unfolded outside the main body, and a pair of arm tensioners includes lower ends hingedly fixed to the front surface of the front press and upper ends configured to be turned and spaced apart from each other.

10 Claims, 10 Drawing Sheets

(56) References Cited

U.S. PATENT DOCUMENTS

| | | | | | |
|---|---|---|---|---|---|
| 2,788,162 | A * | 4/1957 | Hitz | D06F 71/16 | 223/57 |
| 2,948,444 | A * | 8/1960 | Paris | D06F 73/00 | 223/67 |
| 3,216,633 | A | 11/1965 | Paris | | |
| 3,385,485 | A | 5/1968 | Alfred | | |
| 3,480,187 | A * | 11/1969 | Bonn | D06F 71/16 | 223/67 |
| 3,494,516 | A * | 2/1970 | McMillan | D06F 73/00 | 38/17 |
| 4,728,015 | A | 3/1988 | Holzapfel | | |
| 5,692,326 | A | 12/1997 | Mohan | | |
| 5,772,572 | A | 6/1998 | Koch | | |
| 5,970,637 | A * | 10/1999 | Mohan | D06F 71/20 | 38/14 |
| 6,240,559 | B1 | 6/2001 | Cares | | |
| 6,868,996 | B1 * | 3/2005 | Uchikoshi | D06F 71/40 | 223/74 |
| 7,178,275 | B2 | 2/2007 | Grunert | | |
| 2005/0067442 | A1 * | 3/2005 | Redlin | D06F 73/00 | 223/70 |

FOREIGN PATENT DOCUMENTS

| | | | |
|---|---|---|---|
| GB | 837332 | A | 6/1960 |
| GB | 1147679 | A | 4/1969 |
| GB | 2219808 | A | 12/1989 |
| GB | 2225592 | A | 6/1990 |
| JP | 03162900 | | 7/1991 |
| JP | H07-124393 | | 5/1995 |
| JP | 4368347 | | 11/2009 |
| JP | 2014-239740 | | 12/2014 |
| KR | 20-0359125 | U | 8/2004 |
| KR | 20-0419319 | U | 6/2006 |
| KR | 10-2010-0070004 | | 6/2010 |
| KR | 10-2012-0018486 | | 3/2012 |
| KR | 10-2012-0094278 | | 2/2013 |
| KR | 10-1566835 | | 11/2015 |
| WO | WO 2010/084396 | | 7/2010 |

OTHER PUBLICATIONS

European Search Report dated May 26, 2020 on European Patent Application No. 17887945.8.

PCT Search Report dated Apr. 27, 2018 on PCT International Patent Application No. PCT/KR2017/015706.

European Search Report dated Sep. 17, 2021 on European Patent Application No. 21188912.6.

* cited by examiner

GARMENT STEAMER

CROSS-REFERENCE TO RELATED APPLICATIONS

This application is a continuation of U.S. application Ser. No. 16/474,704, filed Jun. 28, 2019, which is a U.S. National Stage entry under 35 U.S.C. § 371 from International PCT Application No. PCT/KR2017/015706, filed Dec. 29, 2017, which claims priority to Korean Application No. 10-2016-0184193, filed Dec. 30, 2016, the contents of all of which are incorporated herein by reference in their entireties.

TECHNICAL FIELD

The present disclosure relates to a garment steamer, and more particularly to a garment steamer for removing wrinkles from a garment using steam.

BACKGROUND ART

A garment is treated in order to remove wrinkles from the garment. Depending on the kind of a garment, treatment methods are classified into a method using an iron and a method using steam.

In recent years, garment steaming capable of rapidly removing wrinkles from a garment using steam in the state in which the garment is held on a stand, such as a hanger, has come to be widely used. In the case in which wrinkles are removed from a garment using steam, however, it is difficult to stably spread and fix the garment.

According to Korean Registered Patent No. KR1190146B1, it is possible to fix and spread a garment to some extent using an upper moving member, a lower moving member, and a stopper. Even in this case, however, when a garment, such as a shirt, is steamed, it is difficult to fix the front surface of the garment. In addition, for a garment having a large number of buttons, such as a shirt, it is necessary to perform a process of fastening the buttons in order to perform garment steaming and then unfastening the buttons after steaming, which is troublesome.

Furthermore, for a conventional garment steamer for performing garment steaming, the space in a room occupied by a stand for holding a garment is large, whereby space utilization is inefficient.

DISCLOSURE

Technical Problem

It is an object of the present disclosure to provide a garment steamer capable of simply fixing a garment and removing wrinkles from the garment using steam.

It is another object of the present disclosure to provide a garment steamer, which occupies minimal space in a room.

Technical Solution

In accordance with an aspect of the present disclosure, the above and other objects can be accomplished by the provision of a garment steamer including a base body including a steam generator for generating steam, a main body disposed at the upper side of the base body for moving the steam generated by the steam generator to the outside, a front press hingedly fixed to the lower part of the main body so as to be attached to and detached from the front surface of the main body, and a stretching means disposed at opposite side surfaces of the main body so as to be unfolded outside the main body, whereby it is possible to easily fix the front surface of a garment using the front press.

In accordance with another aspect of the present disclosure, the garment steamer is configured such that, in a basic mode, in which the garment steamer is not operated, the front press, the side tensioners ("side tensioners", the shoulder tensioners ("shoulder tensioners", and the arm tensioners ("arm tensioners") form a cylindrical shape together with the main body, whereby it is possible to change the shape of the garment steamer such that the volume of the garment steamer is minimized when not in use.

The garment steamer according to the present disclosure may include a pair of arm tensioners having lower ends hingedly fixed to the front surface of the front press and upper ends configured to be turned so as to be spaced apart from each other, whereby it is possible to fix sleeves to be steamed and at the same time to remove wrinkles from the garment.

In addition, the garment steamer according to the present disclosure may further include a front fixing clip disposed between the main body and the front press for pushing the front surface of the main body, whereby it is possible to dually fix the front surface of the garment using the front press and the front fixing clip.

Advantageous Effects

First, the garment steamer according to the present disclosure has an effect in that it is possible to simply fix a garment using the front press and to easily perform garment steaming.

Second, the garment steamer according to the present disclosure has an effect in that, in the basic mode, in which the garment steamer is not operated, the shape of the garment steamer is changed into a cylindrical shape, whereby it is possible to minimize the space in a room occupied by the garment steamer.

Third, the garment steamer according to the present disclosure has an effect in that the garment steamer includes arm tensioners, whereby it is possible to easily fix the sleeves of the garment in order to perform steaming, and therefore it is possible to easily and rapidly perform garment steaming.

BRIEF DESCRIPTION OF THE DRAWINGS

FIGS. 4A and 4B are views illustrating the operation of a front press according to an embodiment of the present disclosure, wherein FIG. 4A is a perspective view and FIG. 4B is a side view.

FIGS. 5A and 5B are views illustrating shoulder tensioners according to an embodiment of the present disclosure, wherein FIG. 5A is a view showing the state in which the shoulder tensioners are folded and FIG. 5B is a view showing the state in which the shoulder tensioners are unfolded.

FIGS. 6A and 6B are views illustrating side tensioners according to an embodiment of the present disclosure, wherein FIG. 6A is a view showing the state in which the side tensioners are folded and FIG. 6B is a view showing the state in which the side tensioners are unfolded.

BEST MODE

Hereinafter, embodiments of a garment steamer according to the present disclosure will be described with reference to the accompanying drawings.

Figure 1:
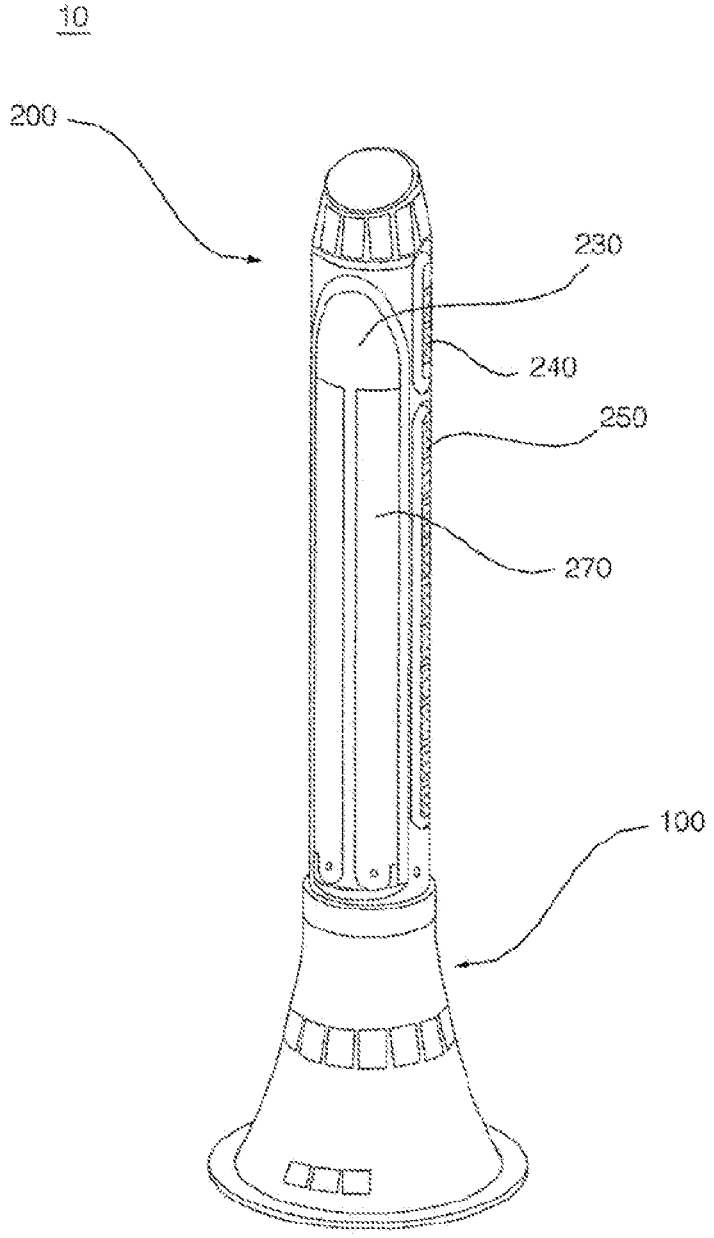
FIG. 1 is a perspective view showing a garment steamer according to an embodiment of the present disclosure in a basic mode.
Figure 2:
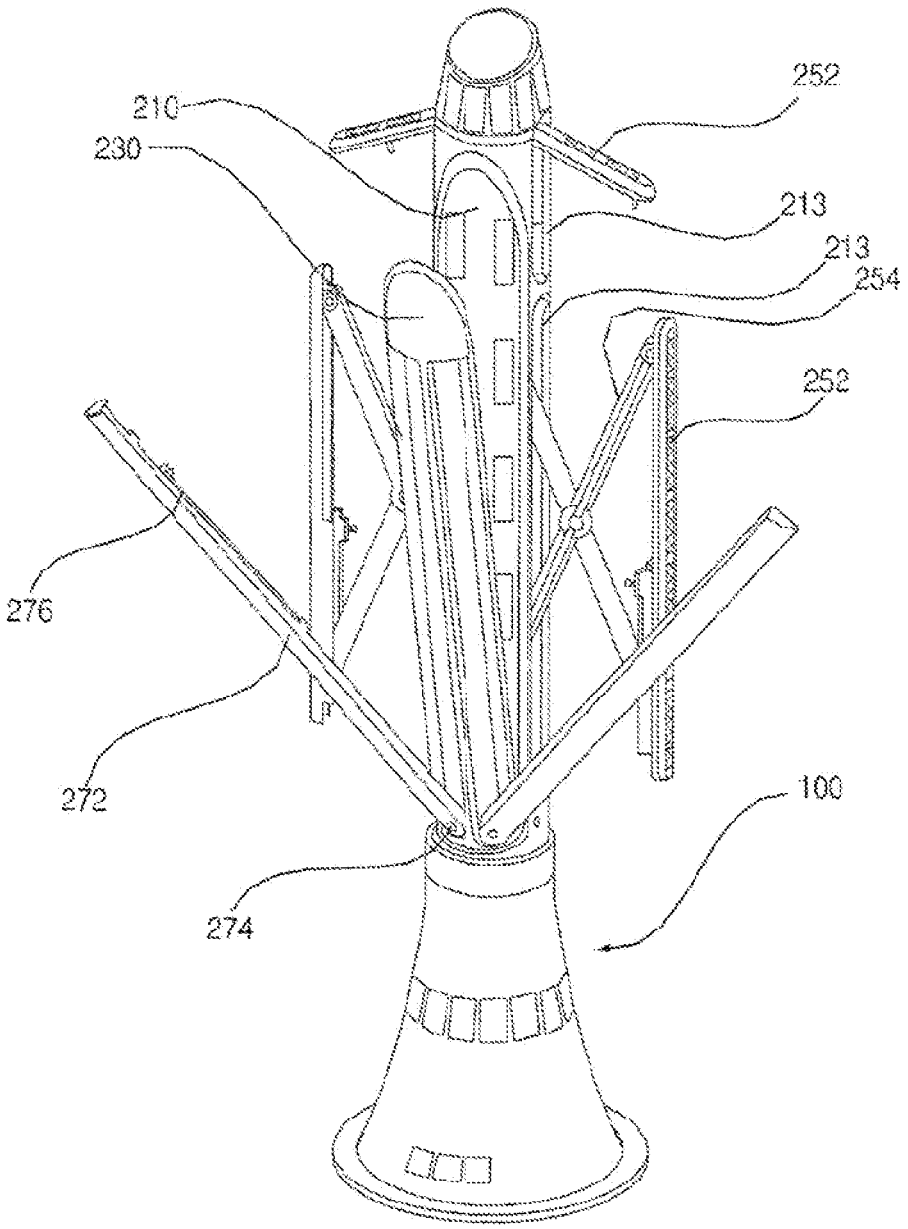
FIG. 2 is a view showing the state in which a front press and a spreading means of the garment steamer according to the embodiment of the present disclosure are unfolded.
Figure 3:
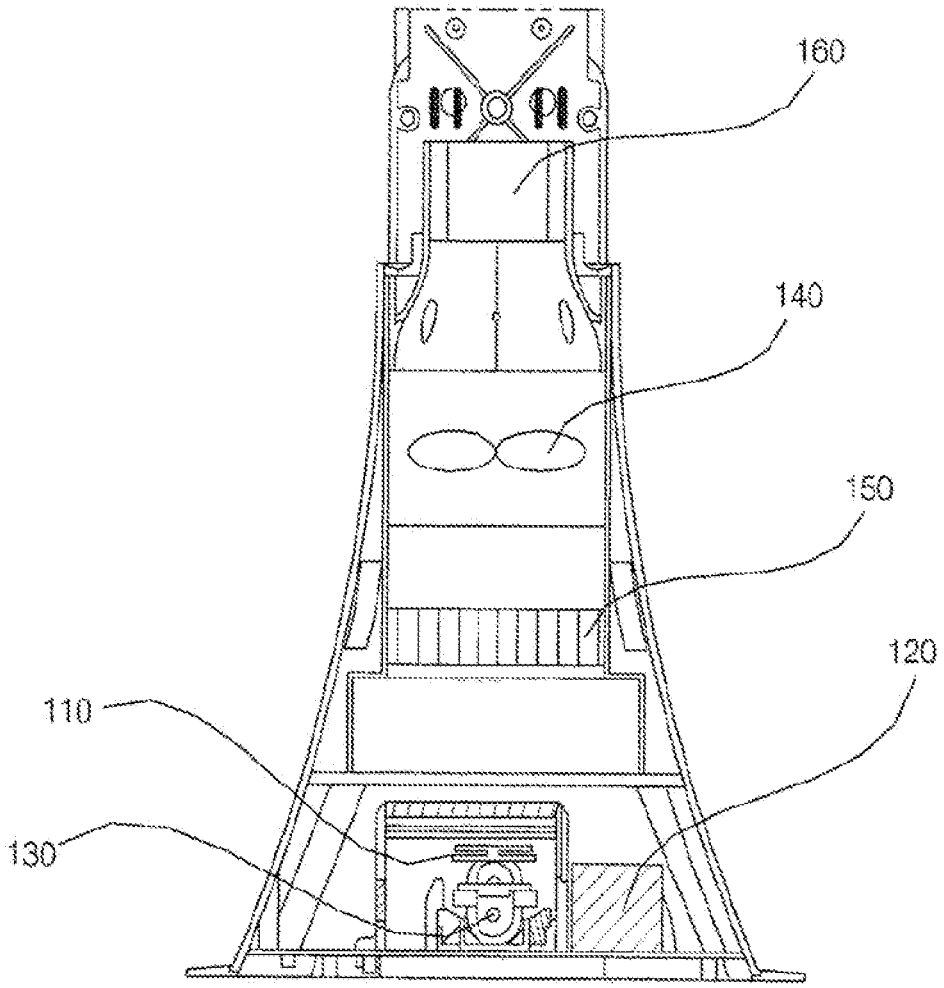
FIG. 3 is a view showing a base body according to an embodiment of the present disclosure.
Figure 7:
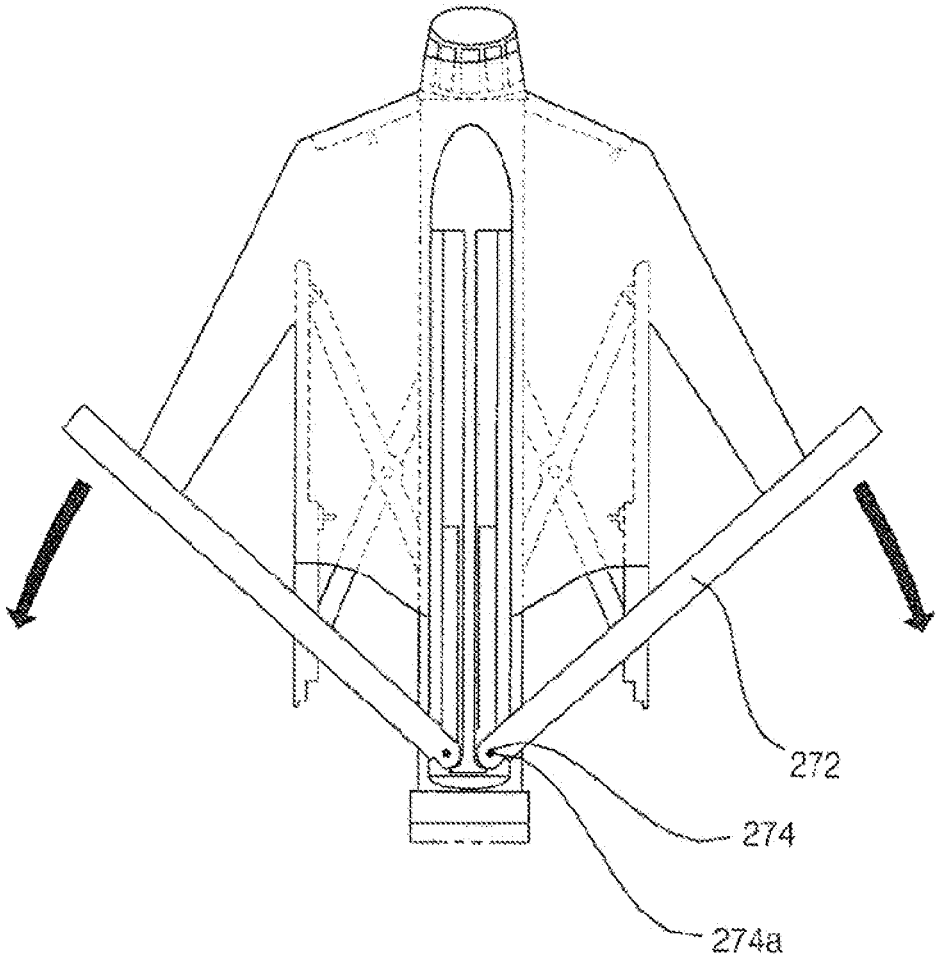
FIG. 7 is a view showing the state in which an upper garment is spread in the state of being fixed to the garment steamer according to the embodiment of the present disclosure.

FIG. 1 is a perspective view showing a garment steamer according to an embodiment of the present disclosure in a basic mode. FIG. 2 is a view showing the state in which a front press and a spreading means of the garment steamer according to the embodiment of the present disclosure are unfolded. FIG. 3 is a view showing a base body according to an embodiment of the present disclosure. FIG. 7 is a view showing the state in which an upper garment is spread in the state of being fixed to the garment steamer 10 according to the embodiment of the present disclosure.

Hereinafter, the overall construction of the garment steamer 10 according to this embodiment, a base body 100, and a main body 200 will be described with reference to FIGS. 1 to 3 and 7.

The garment steamer 10 according to this embodiment is a machine that sprays steam into an upper garment in order to steam the upper garment. The garment steamer 10 according to this embodiment includes a base body 100 including a steam generator for generating steam, a main body 200 disposed at the upper side of the base body 100 for moving the steam generated by the steam generator to the outside, a front press 230 hingedly fixed to the lower part of the main body 200 so as to be attached to and detached from the front surface of the main body 200, and a stretching means disposed at opposite side surfaces of the main body 200 so as to be unfolded outside the main body 200.

The stretching means includes shoulder tensioners 240 hingedly fixed to the upper parts of the opposite side surfaces of the main body 200 so as to be unfolded to the upper side of the main body 200 and a pair of side tensioners 250 disposed at the lower sides of the shoulder tensioners 240 so as to be unfolded from the main body 200 leftwards and rightwards.

The garment steamer 10 according to this embodiment further includes a pair of arm tensioners 270 having lower ends hingedly fixed to the front surface of the front press 230 and upper ends configured to be turned so as to be spaced apart from each other. The stretching means may include the arm tensioners 270.

The garment steamer according to this embodiment, which holds a garment, includes a main body 200, on which the garment is placed, the main body being configured to discharge steam into the garment, a base body 100 for supplying steam to the main body, a front press 230 hingedly fixed to the main body for fixing the front surface of the garment, and a stretching mean for applying tension to the garment placed on the main body.

The stretching means includes a pair of side tensioners 250 disposed at opposite side surfaces of the main body for applying tension to opposite side surfaces of the garment, a pair of shoulder tensioners 240 disposed at the upper sides of the side tensioners 250 for fixing the shoulder parts of the garment, and arm tensioners 270 disposed at the front surface of the front press for applying tension to the sleeves of the garment.

Referring to FIG. 1, the garment steamer 10 according to this embodiment is maintained in a cylindrical shape in a basic state, in which the garment steamer is not operated. In the basic mode of the garment steamer 10, the front press 230, the side tensioners 250, the shoulder tensioners 240, and the arm tensioners form a cylindrical shape together with the main body 200.

The base body 100 according to this embodiment stably supports the main body 200. The base body 100 supplies steam to the main body 200.

Referring to FIG. 3, the base body 100 according to this embodiment includes a water tank 120 for storing water, a steam generator 110 for generating steam using the water stored in the water tank 120, a pump 130 for supplying the water stored in the water tank 120 to the steam generator 110, and an inner duct 160 for discharging the steam generated by the steam generator 110 into the main body 200.

The base body 100 according to this embodiment may further include a fan module 140 for forcing air to smoothly flow to the main body 200 and a heater 150 for heating air that flows to the main duct ("the main body").

Since the base body 1090 includes therein the steam generator 110, the pump 130, and the fan module 140, which are relatively heavy, the center of gravity of the garment steamer 10 is lowered. The base body 100 has a conical shape to stably support the main body 200.

The water tank 120 is a space for storing water that is supplied to the steam generator 110. The water tank 120 may be separably disposed in the base body 100. The steam generator 110 is a device that generates steam using the water stored in the water tank 120. The water in the water tank 120 is supplied to the steam generator 110 by the pump 130.

The inner duct 160 is disposed at the upper side of the base body 100. The inner duct 160 discharges the steam generated by the steam generator 110 into the main body 200. The fan module 140 operates a fan in order to force air to smoothly flow to the main body 200.

A garment is placed outside the main body 200 according to this embodiment. The main body 200 sprays the steam flowing therein to the garment placed outside the main body. The main body 200 fixes the garment using the front press 230 and the stretching means and applies tension to the garment.

The main body 200 is disposed at the upper side of the base body 100. The main body 200 extends from the upper side of the base body 100 in a cylindrical shape. The steam discharged from the inner duct 160 flows in the main body 200.

The front surface 210 of the main body 200 is a part that contacts the front press 230, and has a flat shape corresponding to the front press 230. At the front surface 210 of the main body 200 is disposed a front fixing clip 220 for pushing the front surface 210 of the main body 200. The front fixing clip 220 is fixed to the lower side of the front surface 210 of the main body 200 and extends upwards. The front fixing clip 220 is disposed between the main body 200 and the front press 230. The front fixing clip 220 primarily fixes the front surface of the garment.

The main body 200 may further include a rear fixing clip 222 disposed at the rear surface 214 thereof for pushing the rear surface 214 of the main body 200. The rear fixing clip 222 fixes the rear surface of the garment to the rear surface of the main body 200. The rear fixing clip 222 is fixed to the lower side of the rear surface 214 of the main body 200 and extends upwards.

A plurality of holes, through which the steam flowing in the main body 200 is discharged, is formed in the side surface 212 of the main body 200. The side tensioners 250 and the shoulder tensioners 240 are disposed so as to correspond to the holes formed in the side surface 212 of the main body 200. In the basic mode, in which the garment steamer is not operated, the holes formed in the side surface of the main body 200 are closed by the side tensioners 250 and the shoulder tensioners 240. In an operating mode, in which the garment steamer is operated, the side tensioners 250 and the shoulder tensioners 240 are unfolded leftwards and rightwards, whereby the holes formed in the side surface of the main body 200 are opened.

In the main body 200 is included a first guide rail 216 for moving the lower end 256 of one side of a support 254 of each of the side tensioners 250. The lower end of one side of the support 254, disposed at the middle of the main body 200, of each of the side tensioners 250, which are disposed at opposite sides of the main body 200, is moved along the first guide rail 216. The main body 200 includes a guide clip 218 connected to the lower end of one side of each of a pair of supports 254 so as to be movable along the first guide rail 216.

Since the supports 254 are moved together by the guide clip 218, the side tensioners 250 may apply uniform tension to opposite side surfaces of the upper garment placed on the main body 200.

Figure 4A:
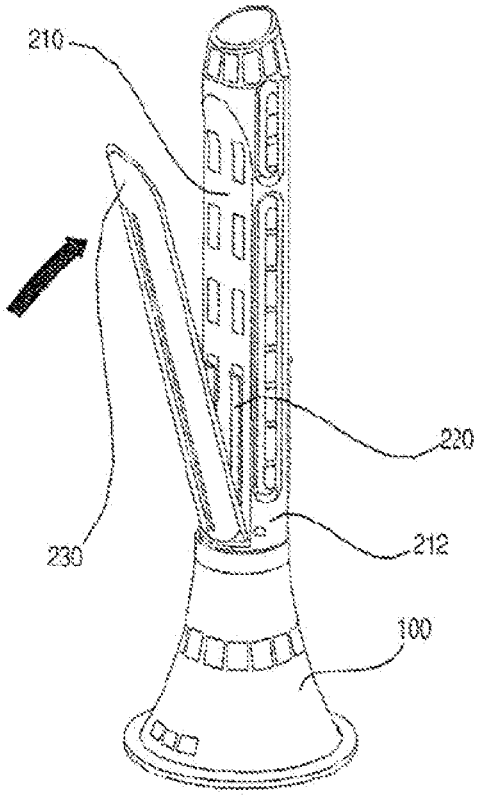
Figure 4B:
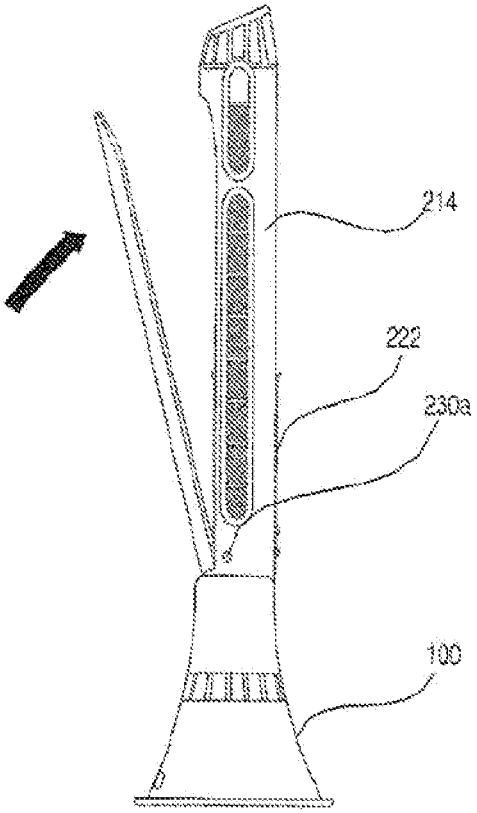

FIGS. 4A and 4B are views illustrating the operation of a front press 230 according to an embodiment of the present disclosure. Hereinafter, the front press 230 according to this embodiment will be described with reference to FIGS. 4A and 4B.

The front press 230 extends in the longitudinal direction of the main body 200. The front press 230 is disposed at the front surface of the main body 200. The front press 230 is hingedly fixed to the lower side of the front surface 210 of the main body 200. The front press 230 is fixed to the main body 200 in tight contact therewith. The front press 230 is detachably attached to the front surface of the main body 200 by a magnetic material. The detachable attachment of the front press 230 using the magnetic material is merely an embodiment. Another member for fixing the front surface of the upper garment between the front surface of the main body 200 and the front press 260 may also be used. The front press 230 secondarily fixes the front surface of the garment placed on the main body 200. The front surface of the garment is fixed between the front press 230 and the main body 200.

The force applied to the front surface of the upper garment due to tight contact between the front press 230 and the main body 200 is greater than the force that the side tensioners 250 apply to the side surfaces of the upper garment. Even when the side tensioners 250 apply tension to the upper garment placed on the upper side of the main body 200, therefore, the state in which the front surface of the upper garment is fixed by the front press 230 is not released.

Since the front fixing clip 220 and the front press 230 fix the front surface of the garment, it is possible for a user to fix a shirt ("the garment") even in the state in which buttons of the shirt ("garment") are not fastened.

Referring to FIGS. 4A and 4B, a turning shaft 230*a* of the front press 230 according to this embodiment is formed in the main body 200. The turning shaft 230*a* of the front press 230 is formed in the main body 200, whereby the front press 230 is prevented from being turning too far forwards about the turning shaft 230*a*.

Figure 5B:
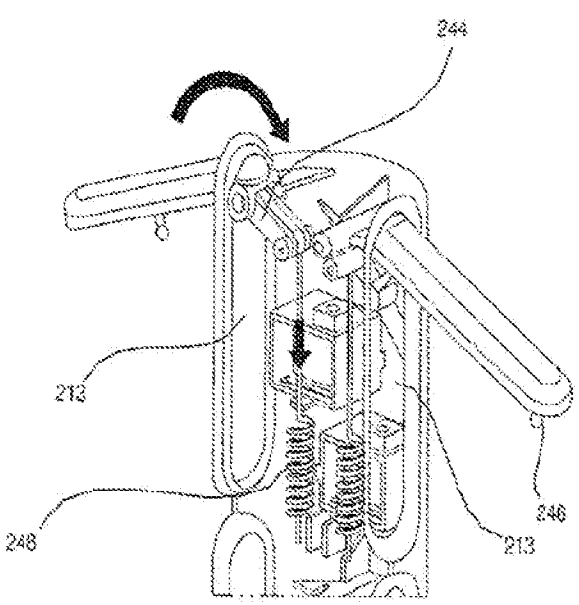
Figure 5A:
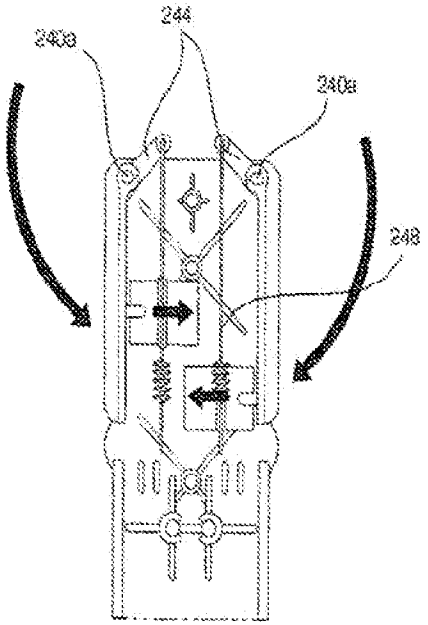
Figure 6A:
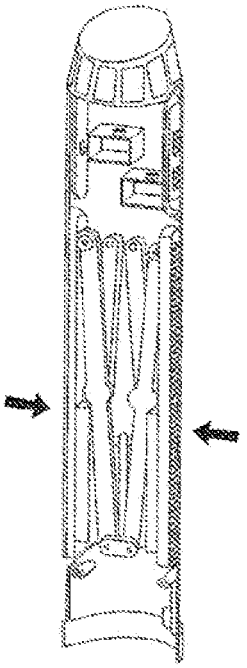
Figure 6B:
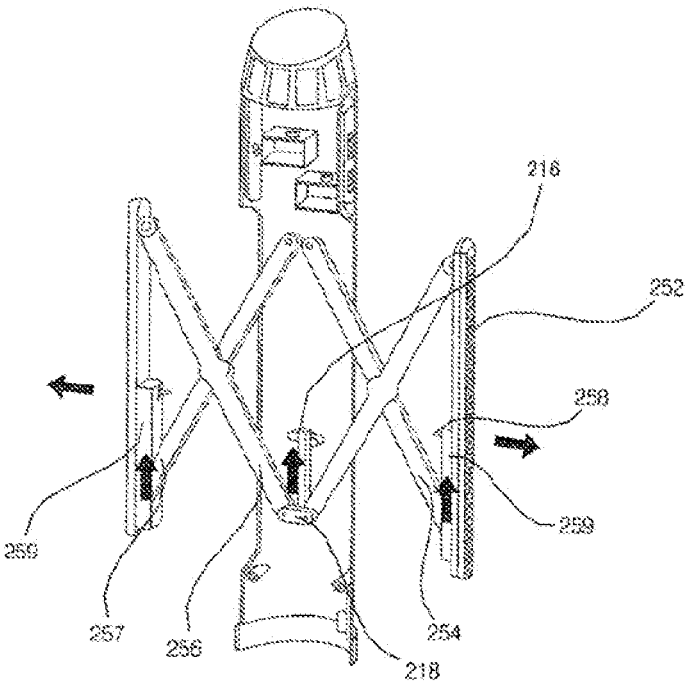
Figure 8:
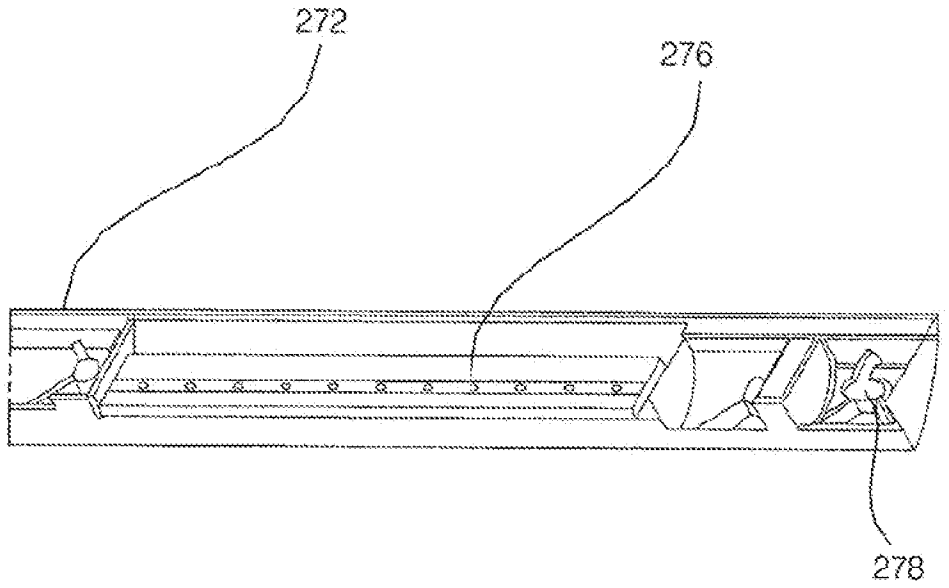
FIG. 8 is a view showing an arm tensioner including a sleeve fixing unit according to an embodiment of the present disclosure.

FIGS. 5A and 5B are views illustrating shoulder tensioners according to an embodiment of the present disclosure. FIGS. 6A and 6B are views illustrating side tensioners according to an embodiment of the present disclosure. FIG. 7 is a view showing the state in which an upper garment is spread in the state of being fixed to the garment steamer according to the embodiment of the present disclosure. FIG. 8 is a view showing an arm tensioner including a sleeve fixing unit according to an embodiment of the present disclosure.

Hereinafter, the shoulder tensioners 240, the side tensioners 250, and the arm tensioners 270 of the garment steamer 10 according to this embodiment will be described with reference to FIGS. 5A to 8.

The shoulder tensioners 240 are disposed at the upper parts of the side surfaces 212 of the main body 200. The shoulder tensioners 240 fix the shoulder parts of the upper garment. The shoulder tensioners 240 apply tension to the shoulder parts of the upper garment. The shoulder tensioners 240 enable the upper garment to be stably placed on the main body 200. Each of the shoulder tensioners 240 is turned about a hinge shaft formed at the upper end of the shoulder tensioner. The shoulder tensioners 240 are unfolded from the opposite side surfaces of the main body 200 to the upper side of the main body 200.

Each of the shoulder tensioners 240 includes a hanger 242 hingedly fixed to the side surface of the main body 200, a hanger lever 244 configured to be turned together with the hanger 242, the hanger lever 244 being bent from one end of the hanger 242 and extending into the main body 200, an elastic member 248 for applying elastic force to the end of the hanger lever 244 in order to unfold the hanger 242 to the upper side of the main body 200, and a one-touch click button 246 for fixing the hanger 242 to the side surface of the main body 200.

The hanger 242 is the part that holds the garment. The hanger 242 supports the shoulder part of the upper garment. The hanger 242 is provided with communication holes, through which air or steam flows. The steam discharged to the outside of the main body 200 is applied to the upper shoulder part of the upper garment through the communication holes. The elastic member pulls one side of the hanger lever 244 downwards. When the locked state of the one-touch click button 246 is released, the hanger 242 is turned about the hinge shaft 240*a* so as to be unfolded to the upper side of the main body by the elastic force of the elastic member.

The one-touch click button 246 is mounted to each of a pair of hangers 242. However, the one-touch click buttons 246 may be disposed at different positions of the hangers 24 in consideration of the space in the main body 200.

When the user pushes the one-touch click button 246, the locked state of the one-touch click button 246 is released. When the locked state of the one-touch click button 246 is released, the other end of the hanger lever 244 is pulled by the elastic member 248 due to the elastic force of the elastic member 248. At the result of turning of the hanger lever 244, the hanger 242 protrudes outwards from the side surface of the main body 200. When the locked state of the one-touch click button 246 is released, the hanger 242 fixes the shoulder part of the upper garment placed on the main body 200.

The side tensioners 250 apply uniform tension to the left and right sides of the upper garment placed on the main body 200 in order to remove wrinkles from the upper garment. The side tensioners 250 are disposed at opposite side surfaces of the main body 200. The side tensioners 250 are disposed at the lower sides of the shoulder tensioners 240.

Each of the side tensioners 250 includes a side bar 252 disposed at the side surface of the main body 200 in the longitudinal direction thereof, a support 254 for moving the side bar 252 in the leftward-rightward direction of the main body 200, an elastic member 260 for applying elastic force to one side of the support 254, and a one-touch click button 258 for fixing the side bar 252 to the side surface of the main body 200. The support 254 according to this embodiment has an X shape. However, this is merely an embodiment. The support may have any other shape, as long as the support is capable of moving the side bar 252 to the outside of the main body 200.

The side bar 252 contacts the inner surface of the upper garment. The side bar 252 includes therein a second guide rail 259, along which the lower end of the other side of the support 254 is movable. The side bars 252 spread the inner surface of the upper garment leftwards and rightwards.

One of the upper and lower ends of the support 254 is fixed, and the other is moved to move the side bar 252 leftwards and rightwards. Referring to FIGS. 6A and 6B, the upper end of the support 254 according to this embodiment is fixed, and the lower end thereof is moved. However, this is merely an embodiment. The lower end of the support may be fixed, and the upper end thereof may be moved.

The lower end 256 of one side of the support 254 is moved along the first guide rail 216. The lower end 256 of one side of each support 254 is fixed to the guide clip 218, which is moved along the first guide rail 216.

The guide clip 218 is moved upwards by the elastic member 260 unless external force is applied thereto. The lower end 257 of the other side of the support 254 is moved along the second guide rail 259. When the lower end 256 of one side of the support 254 is moved along the first guide rail 216 by the elastic member, the lower end 257 of other side of the support 254 is also moved along the second guide rail 259. When the lower ends 256 and 257 of both sides of the support 254 are moved along the first and second guide rails 215 and 259, respectively, the side bar 252 is moved in the leftward-rightward direction of the main body 200.

The user may apply pressure to the side bar 252 in order to release the locked state of the one-touch click button 258. When the locked state of the one-touch click button 258 is released, the elastic member 260 moves the guide clip 218 to the upper side of the first guide rail 216. When the guide clip 218 is moved upwards, the support 254 pushes the side bar 252 leftwards or rightwards. The side bar 252 is moved from the side surface of the main body 200 in the outward direction of the main body 200.

The arm tensioners 270 fix the sleeves of the upper garment placed on the main body 200 while applying tension to the sleeves in order to remove wrinkles from the sleeves of the upper garment. The arm tensioners 270 pull the sleeves of the upper garment in order to apply tension to the sleeves.

The arm tensioners 270 are disposed at the front surface of the front press 230. The lower ends of the arm tensioners 270 are hingedly fixed to the front surface of the front press 230, and the upper ends thereof are turned so as to be spaced apart from each other. Each of the arm tensioners has a hinge shaft 274*a* formed at the lower end of the front press 230. The hinge shaft 274*a* of each of the arm tensioners 270 is formed so as to be perpendicular to the turning shaft 230*a* of the arm tensioner ("front press").

Each of the arm tensioners 270 includes an arm tension bar 272 configured to be turned so as to apply tension to a corresponding one of the sleeves of the upper garment, an arm tensioner hinge unit 274, about which the arm tension bar 272 is turned, and a sleeve fixing unit 276 disposed at the end of the arm tension bar 272 for fixing a corresponding one of the sleeves of the upper garment placed on the main body 200.

The sleeve fixing unit 276 fixes the sleeve of the upper garment to the arm tension bar 272 in a clamping manner. The sleeve fixing unit 276 prevents the leakage of steam flowing to the sleeve of the upper garment.

Each of the arm tensioners 270 may include a one-touch click button 278 for fixing the arm tensioner 270 to the front press 230.

Figure 9:
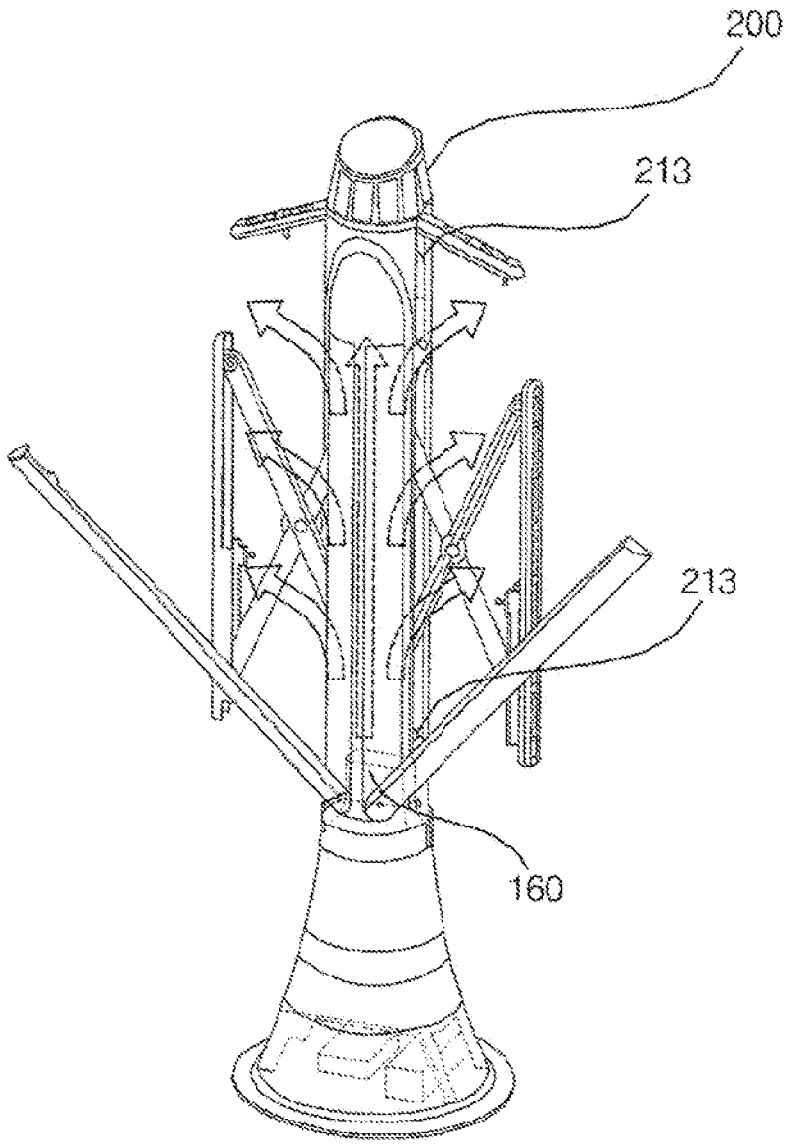
FIG. 9 is a view illustrating the flow of steam in the garment steamer according to the embodiment of the present disclosure.

FIG. 9 is a view illustrating the flow of steam in the garment steamer 10 according to the embodiment of the present disclosure. Hereinafter, the flow of steam in the garment steamer 10 will be described with reference to FIG. 9.

In the garment steamer 10 according to the embodiment, the steam generated by the steam generator 110 in the base body 100 flows to the main body 200 through the inner duct 160. For smooth flow of the steam, the fan module 140, disposed in the base body 100, may be operated.

The steam introduced into the main body 200 through the inner duct 160 is discharged to the outside through the side holes 213 in the main body 200. In the operating mode, in which the steam generator of the garment steamer generates steam, the side tensioners 250 and the shoulder tensioners 240, disposed at the side surfaces 212 of the main body 200, are unfolded to the outside of the main body 200. When the side tensioners 250 and the shoulder tensioners 240 are unfolded from the opposite side surfaces of the main body 200, the side holes 213 formed in the side surfaces of the main body 200 are opened.

When the side holes 213 in the main body 200 are opened as the result of the movement of the side tensioners 250 and the shoulder tensioners 240, the steam flowing in the main body 200 is discharged to the outside through the side holes 213.

FIGS. 10A-10D are views sequentially showing a method of operating the garment steamer according to the embodiment of the present disclosure. Hereinafter, the method of operating the garment steamer according to this embodiment will be described with reference to FIGS. 10A-10D.

Figure 10D:
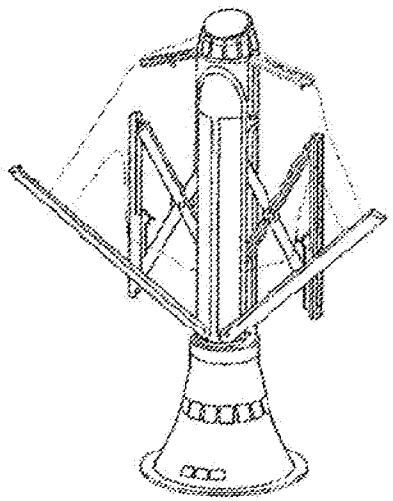
FIGS. 10A-10D are views sequentially showing a method of operating the garment steamer according to an embodiment of the present disclosure.
Figure 10C:
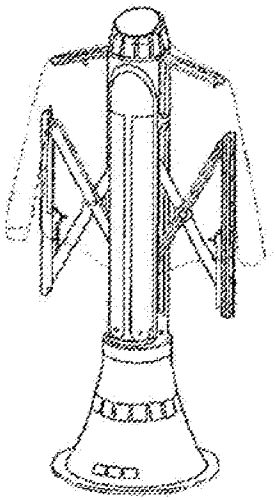
Figure 10B:
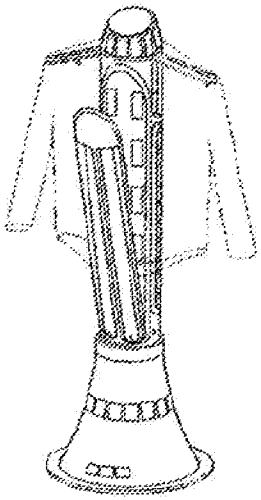
Figure 10A:
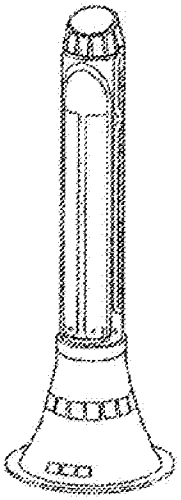

In the basic mode, in which the garment steamer 10 is not operated, the garment steamer 10 is maintained in a cylindrical shape, as shown in FIG. 10A.

A step of placing an upper garment on the main body 200 is performed. Referring to FIG. 10B, the shoulder tensioners 240 are unfolded from the main body 200 and the front press 230 is moved forwards in order to place the upper garment on the main body 200. The front surface of the upper garment may be fixed by the front fixing clip 220, and the rear surface of the upper garment may be fixed by the rear fixing clip 222.

A step of fixing the front surface of the upper garment using the front press 230 is performed. The front press 230 is attached to the front surface of the main body 200 due to the magnetic material included therein. Referring to FIG. 10C, the front press 230 fixes the middle of the front surface of the upper garment. It is possible to fix the front surface of the upper garment to be steamed using the front press 230 even in the case in which buttons of the upper garment are not fastened.

A step of unfolding the side tensioners 250, disposed at opposite sides of the main body 200, is performed. Referring to FIG. 10C, the side tensioners 250 apply tension to the inner surface of the upper garment in order to prevent wrinkles from being formed in the garment. Since the front surface of the upper garment is fixed by the front press 230, tension is applied to the upper garment when the side tensioners 250 are moved.

A step of unfolding the arm tensioners, disposed at the front surface of the front press 230, is performed. Referring to FIG. 10D, the arm tensioners fix the sleeves of the upper garment using the sleeve fixing units 276, and turn about the hinges disposed at the lower sides thereof to apply tension to the sleeves of the upper garment.

A step of generating steam by the steam generator 110 of the base body 100 and discharging the steam to the outside of the main body 200 is performed. The steam generated by the steam generator 110 flows into the main body 200 through the inner duct 160. The steam flowing in the main body 200 flows out of the main body 200 through the side holes 213. The steam discharged through the side holes 213 flows in the upper garment placed over the main body 200 in order to steam the upper garment.

The invention claimed is:

1. A garment steamer comprising:

a base body comprising a steam generator configured for generating steam;

a main body disposed at an upper side of the base body and configured for directing the steam generated by the steam generator to an outside of the main body; and a pair of side tensioners disposed at opposite side surfaces of the main body and configured to be folded and unfolded from the main body in leftward and rightward directions, wherein the main body comprises an inner duct configured to receive and direct the steam generated by the steam generator, and first side holes defined in each of the opposite side surfaces of the main body in fluid communication with the inner duct and through which the steam flowing in the inner duct is discharged to the outside of the main body, and wherein the pair of side tensioners are each configured to open the first side holes defined in a respective side surface of the main body when the side tensioners are unfolded from the main body.

2. The garment steamer according to claim 1, wherein each of the pair of side tensioners comprises:

a side bar disposed at a respective one of the opposite side surfaces of the main body and extending in a longitudinal direction along the respective one of the opposite side surfaces;

a support configured for moving the side bar in an outward direction relative to the main body; and an elastic member configured for applying an elastic force to one end of the support, wherein the side bar is configured to open and close the first side holes defined in the respective one of the opposite side surfaces.

3. The garment steamer according to claim 1, further comprising a pair of shoulder tensioners hingedly connected to upper parts of the opposite side surfaces of the main body and configured to be folded and unfolded relative to an upper side of the main body, wherein the main body comprises second side holes defined along the upper parts of the opposite side surfaces of the main body in fluid communication with the inner duct and through which the steam flowing in the inner duct is discharged to the outside of the main body, and wherein the pair of shoulder tensioners are configured to open and close the second side holes when unfolded and folded relative to the main body.

4. The garment steamer according to claim 3, wherein each of the shoulder tensioners is configured to rotate around a hinge shaft disposed at an upper end of each of the shoulder tensioners.

5. The garment steamer according to claim 3, wherein each of the shoulder tensioners comprises:

a hanger hingedly fixed to the main body;

a hanger lever configured to be turned together with the hanger, the hanger lever being bent from one end of the hanger and extending into the main body; and an elastic member configured for applying elastic force to an end of the hanger lever in order to unfold the hanger to the upper side of the main body, wherein the hanger is configured to open and close the second side holes.

6. The garment steamer according to claim 3, wherein the second side holes are disposed above the first side holes.

7. The garment steamer according to claim 1, further comprising:

a front press hingedly fixed to a lower part of the main body and configured to be attached to and detached from a front surface of the main body; and a front fixing clip disposed between the main body and the front press and configured to press against the front surface of the main body.

8. The garment steamer according to claim 7, further comprising a rear fixing clip configured to press against a rear surface of the main body.

9. The garment steamer according to claim 7, further comprising a pair of arm tensioners having lower ends hingedly fixed to a front surface of the front press and upper ends configured to be turned so as to be spaced apart from each other.

10. The garment steamer according to claim 2, wherein the support is configured to move the side bar to an outside of the main body through upward and downward movements of an end of one side of the support, wherein the main body comprises a first guide rail for guiding the upward and downward movements of the end of the one side of the support, and wherein the side bar comprises a second guide rail, along which an end of the other side of the support is movable.

* * * * *